United States Patent [19]

Sherman, Jr.

[11] Patent Number: 4,478,418

[45] Date of Patent: Oct. 23, 1984

[54] THREE-DIMENSIONAL SLIDING ELEMENT PUZZLE

[76] Inventor: Benjamin F. Sherman, Jr., 6329 Mori St., McLean, Va. 22101

[21] Appl. No.: 345,051

[22] Filed: Feb. 2, 1982

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS

| | | | |
|---|---|---|---|
| 3,081,089 | 3/1963 | Gustafson | 273/156 |
| 4,344,623 | 8/1982 | Isobe | 273/153 S |

FOREIGN PATENT DOCUMENTS

| | | | |
|---|---|---|---|
| G8106197 | 9/1981 | Fed. Rep. of Germany | 273/153 S |
| G8110092 | 10/1981 | Fed. Rep. of Germany | 273/153 S |
| 55-8193 | 3/1980 | Japan | 273/153 S |

*Primary Examiner*—Anton O. Oechsle

*Attorney, Agent, or Firm*—Anthony A. O'Brien

[57] ABSTRACT

A three-dimensional sliding element puzzle has a spherical support with circular tracks receiving legs and feet of slidable outer shell members defining either a spherical octahedron, cuboctahedron, or icosidodecahedron.

2 Claims, 18 Drawing Figures

THREE-DIMENSIONAL SLIDING ELEMENT PUZZLE

TECHNICAL FIELD

The present invention relates to a puzzle having a plurality of parts arranged in a generally spherical configuration wherein groups of the parts may be moved relative to the corresponding opposing groups to rearrange the parts in the spherical configuration.

DESCRIPTION OF THE PRIOR ART

The prior art as exemplified in U.S. Pat. No. 3,081,089, Hungarian Pat. No. 170,062, Japanese Pat. No. 55-3956, Japanese Pat. No. 55-8192, and Japanese Pat. No. 55-8193, contains a number of puzzles having parts which are arranged in a cubic or spherical arrangement wherein groups of the parts may be rotated relative to the corresponding opposing groups to rearrange the parts.

SUMMARY OF THE INVENTION

The invention is summarized in a three-dimensional sliding element puzzle including a spherical center support having means forming at least three mutually transverse crossing tracks wherein each track forms a complete circle on the support and includes a pair of outer lips extending toward each other to define a narrow outer slot and an inner enlarged sliding path, the narrow outer slots having a width less than one-sixteenth of the circumference of the support, a plurality of at least eight outer members wherein one of the outer members is fixed on the support and the other outer members are slidable on the support, legs mounted on the slidable outer members and extending through the narrow slots of the corresponding tracks, disk-like feet which are substantially round in circumference being mounted on the inner ends of the respective legs for sliding in the inner sliding paths and for being engaged by inner surfaces of the lips to slidingly retain the slidable members on the support, the outer members forming a shell completely enclosing the spherical support with edges of each outer member slidingly abutting edges of the adjoining outer members, and the outer members when in one relative position defining at least three different pairs of hemispherical shells wherein one hemispherical shell of each pair of the pairs of hemispherical shells is rotatable relative to the corresponding other hemispherical shell with the abutting edges of the hemispherical shells of each pair of hemispherical shells sliding relative to each other.

An object of the invention is to construct a pleasing and easily operatable toy or puzzle with a plurality of movable parts.

Anther object of the invention is to construct a puzzle having parts easily movable around a spherical support without any tendency to hang up.

Other objects, advantages and features of the invention will be apparent from the following description of the preferred embodiment taken in conjunction with the accompanying drawings.

DESCRIPTION OF THE PREFERRED EMBODIMENT

Figure 1:
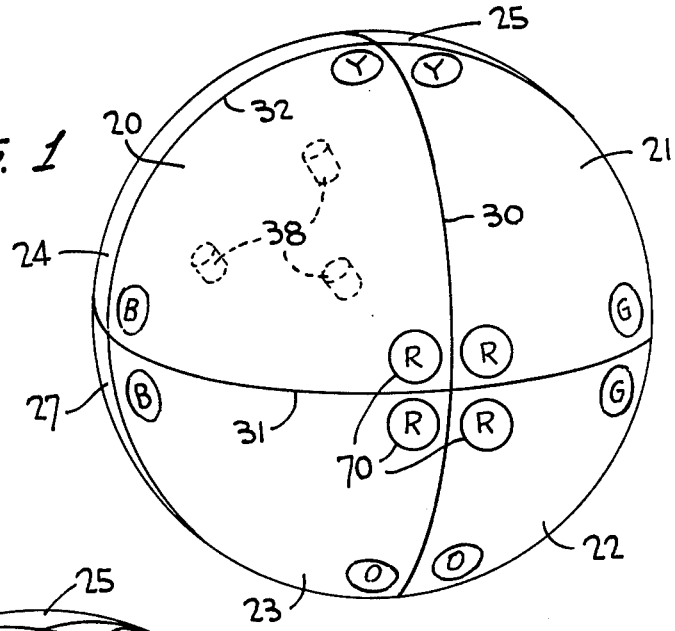
FIG. 1 is a perspective view of a three-dimensional sliding element puzzle constructed in accordance with the invention.
Figure 2:
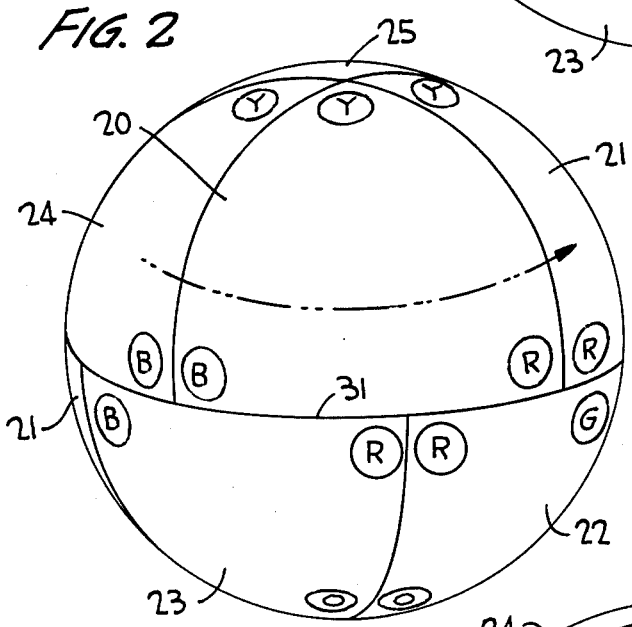
FIG. 2 is a perspective view similar to FIG. 1 but illustrating movement of one hemispherical group of parts about a first axis.
Figure 3:
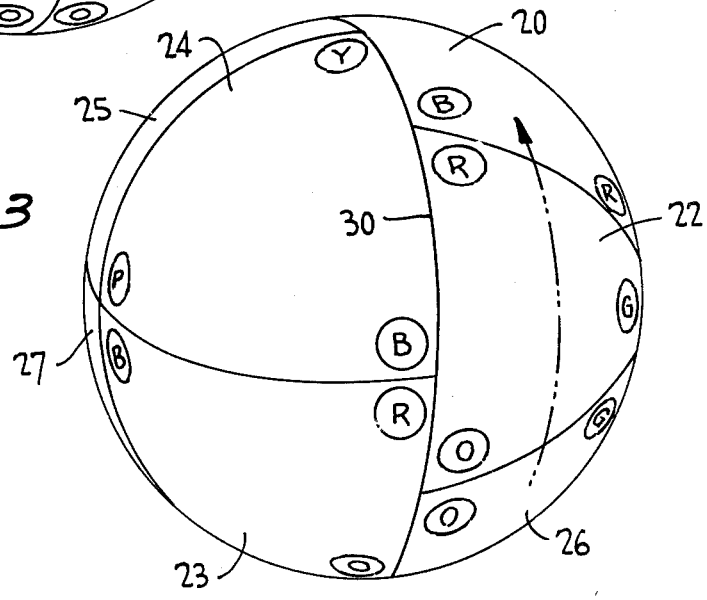
FIG. 3 is a view similar to FIGS. 1 and 2 but illustrating movement of another hemispherical group of parts about a second axis.
Figure 4:
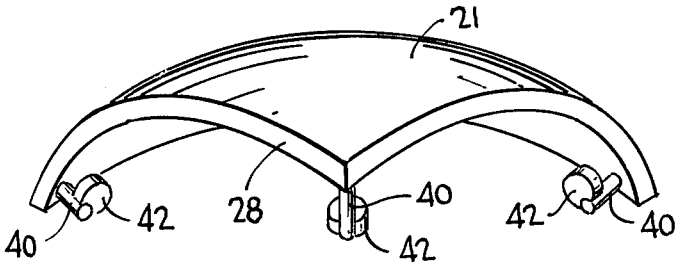
FIG. 4 is a perspective view of a slidable part of the puzzle of FIG. 1.
Figure 5:
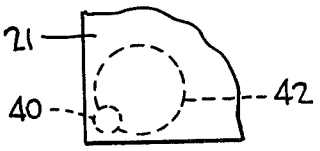
FIG. 5 is a plan view of one corner broken-away from the part of FIG. 4.
Figure 6:
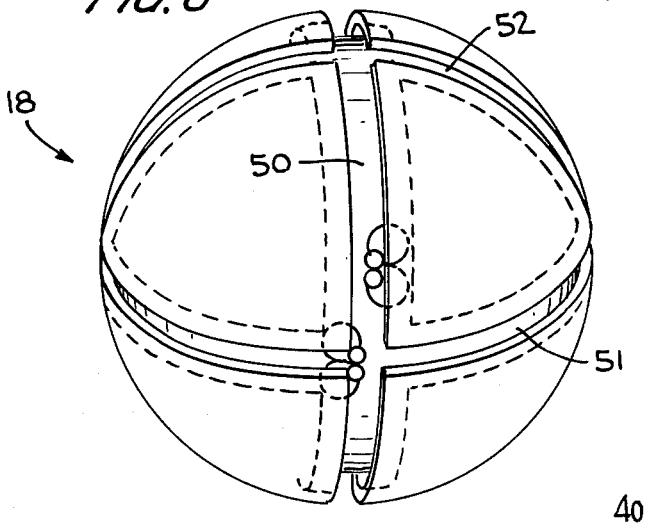
FIG. 6 is a perspective view of a center support of the puzzle of FIG. 1.

One embodiment of the invention, as shown in FIGS. 1–8, includes an inner spherical support indicated generally at 18 in FIG. 6 enclosed by outer shell members 20, 21, 22, 23, 24, 25, 26 and 27, FIGS. 1–3. Each of the outer members 20, 21, 22, 23, 24, 25, 26 and 27 of the embodiment of FIGS. 1–8 include an outer shell portion 28, FIG. 4, which is an octant or one-eighth of a spherical shell of uniform thickness having three substantially right angle corners with three equal curved edges joining the respective corners. In the position shown in FIG. 1, the curved edges of the members 20,21, 22, 23, 24, 25, 26 and 27 extend in respective great circles 30, 31 and 32 which are all mutually perpendicular and bisect the outer shell into corresponding hemispheres; i.e., the great circle 30 bisects the outer shell into a right hemisphere composed of octant members 21, 22, 25 and 26 and a left hemisphere composed of octant members 20, 23, 24 and 27, the great circle 31 bisects the shell into an upper hemisphere composed of octant members 20, 21, 24 and 25 and a lower hemisphere composed of members 22, 23, 26 and 27, and the great circle 32 bisects the shell into a front hemisphere composed of octant members 20, 21, 22 and 23 and a rear hemisphere composed of octant members 24, 25, 26 and 27. The outer shell members 20, 21, 22, 23, 24, 25 26 and 27 all fit together with their respective edges abutting to form a completely enclosed shell.

One outer shell member 20 is fixed to the inner support, for example, by pins 38, and the other outer shell members 21, 22, 23 24, 25, 26 and 27 are slidably mounted on the inner support 18. As shown for the member 21 in FIG. 4, legs 40 are mounted on the inside of the respective corners of the member 21 to extend inward at mutually perpendicular directions. Circular disk-like feet 42 are mounted eccentrically on the inner ends of the legs 40 as shown in FIG. 8 such that upper and lower surfaces of the feet 42 extend perpendicular to the respective legs 40. The circular cross sections of both the leg 40 and the disk 42 at each corner, FIG. 5, are tangential to common perpendicular lines which are parallel to and slightly spaced inward from the respective edges adjacent the corresponding corner such that the feet 42 extend toward the geometric center of the shell member 21. The support 18, FIG. 6, has three mutually perpendicular tracks 50, 51 and 52 which are centered relative to the respective great circle lines 30, 31 and 32 of FIG. 1. Each track, as shown for the track 50 in FIG. 7, has a cross-section defining an upper narrow slot 56 formed between lips 58 of the support 18 and has an enlarged or wide lower portion 60 which extends beneath the lips 58 for receiving the feet 42. The width of the slot 56 must be less than one-sixteenth of the circumference of the support 18, and in one suitable example is about one-thirty-second of the circumference. The diameter of the feet 42 is greater than the width of the slots 56 so that they will always extend beneath the lips 58 for retaining the outer shell members 21 on the support.

The great circles 30, 31 and 32 of FIG. 1 intersect at six locations forming conjunctions where corners of four respective shell members meet. The position of the fixed octant 20 is set to insure that the six conjunctions coincide with the respective six junctions or intersections of the three tracks 50, 51 and 52 to position the legs 40 and feet 42 in the track intersections as shown in FIG. 8. Preferably the feet 42, the lips 58, and the base 60 of the tracks are spherically formed concentric with other parts of the sphere.

Figure 7:
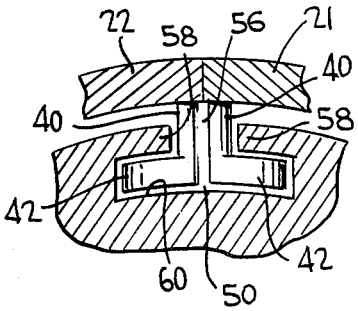
FIG. 7 is a sectional view of a broken-away portion of the assembled puzzle of FIG. 1.
Figure 8:
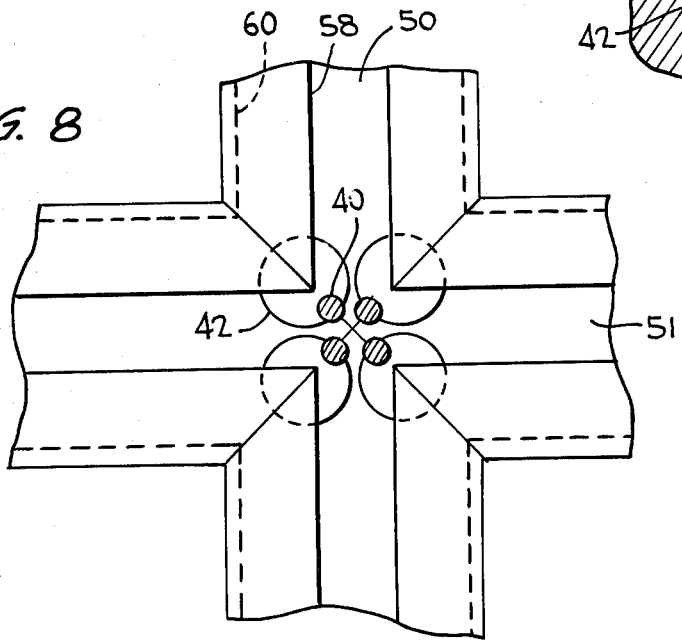
FIG. 8 is a detailed view of a portion of the support of FIG. 1 with feet of sliding members shown at a junction or intersection of tracks of the support.

For the embodiment shown in FIGS. 5, 6 and 7 the tracks 50, 51 and 52 are formed by machining from a solid sphere of wood. Alternatively, the support structure 18 can be formed by assembling parts such as twelve identical curved pieces that form sections of the tracks extending from one junction to the next, or by assembling appropriate parts of different spherical shells. Plastic molding processes can be used to make the parts.

Markings such as spots of color 70, numbers, a map of the earth, or other characteristic indications may be placed on the outer shell members to indicate a starting position or orientation of the respective members 20, 21, 22, 23, 24, 25, 26 and 27. In the example of FIGS. 1–3, color spots 70 of the same color are placed on the four corners forming a single conjunction in the initial position with each of the six conjunctions having a different color.

The puzzle may be manipulated by rotating one hemisphere relative to another hemisphere about an axis of one of the great circles 30, 31 and 32. For example, as shown in FIG. 2, the top hemisphere is rotated counterclockwise relative to the bottom hemisphere until the member 20 is directly above the member 22 to reestablish the great circle line 30. Then as shown in FIG. 3 the right hemisphere is rotated clockwise relative to the left hemisphere. Thus the various colors can be scrambled on the puzzle, and the colors, once scrambled, can be then unscrambled or solved by rotating hemispheres of the puzzle.

The abutting edges of the members 20, 21, 22, 23, 24 25, 26 and 27 distribute applied forces to adjacent members lessening any forces tending to break the legs 40 or feet 42. The relatively narrow width of the slots 56, i.e., less than one-sixteenth of the circumference of the support 18, prevents the leading edge of foot 42 from significantly rising due to slight tilting of the foot when crossing an intersection of two tracks; greater widths of slots permit slight tilting of a foot to cause the leading edge of a foot to rise in an intersection and either (1) override the lip of the next track section causing the sliding member to become disassembled or (2) abut the edge of the lip of the next track section to stop movement of the member. The circular shape of the feet 42 insure that the feet will slide past each other in the event a leg becomes bent or tilted to cause one foot to engage another; the circular shape will cause two engaging feet to cam and slip past each other.

Figure 9:
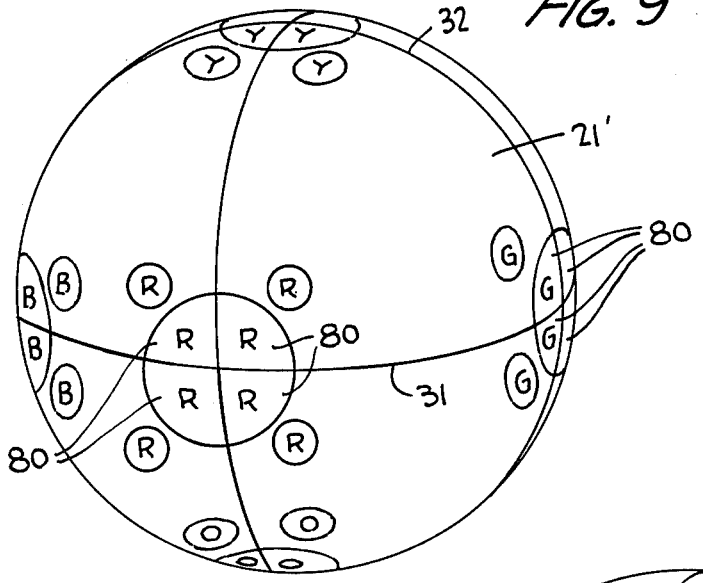
FIG. 9 is a perspective view of a modified three-dimensional sliding element puzzle in accordance with the invention.
Figure 10:
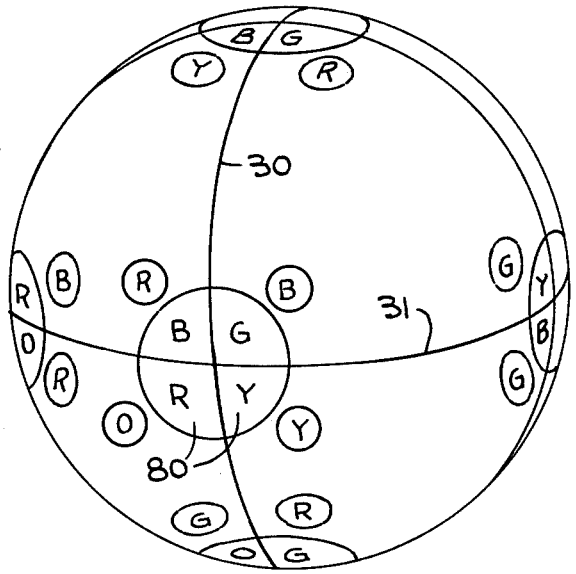
FIG. 10 is a perspective view similar to FIG. 9 but showing sliding elements of the modified puzzle in another arrangement.
Figure 11:
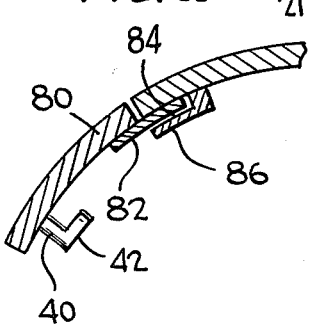
FIG. 11 is a sectional view of a broken-away portion of the puzzle of FIG. 9.
Figure 12:
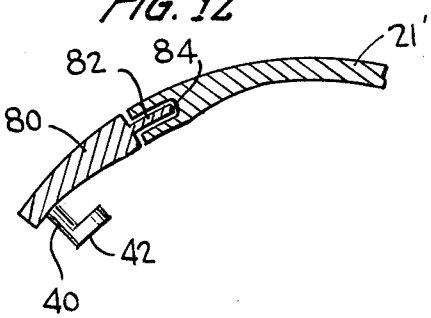
FIG. 12 is a sectional view similar to FIG. 11 of a variation of the broken-away portion.

In a modified puzzle shown in FIGS. 9, 10, 11 and 12, the eight outer spherical octant members are modified, as illustrated for the octant member 21' to include corner pieces 80 at each of the three corners. Each of the corner pieces 80 is a quarter sector of a circular portion of the spherical shell with a spherical right angle corner formed by two sides and with the third side being a circular arc with its radius of curvature centered at the corner so that at a conjunction the four corner pieces form a complete circle. The pieces 80, along their outer circular edges, are slidably mounted in the octant members, for example, by tongues 82 extending from the circular edges of the pieces 80 into corresponding slots 84 formed in the mating edge of the octant members, as shown for the piece 80 in octant member 21' in FIGS. 11 and 12. In FIG. 11 the tongue 82 is shown as a separate part mounted on the inside surface of the piece 80 while the slot 84 is formed by a member 86 mounted on the interior surface of the octant member 21, and in FIG. 12 the tongue 82 is shown as an integral extension of the piece 80 with the slot 84 being formed in an enlarged portion of the shell member 21'. The legs 40 and feet 42 are mounted on the corners of the pieces 80 to retain the octant members on the center support in the same manner as in the variation of FIGS. 1–8. The pieces 80 also have a color which matches the color of the marking on the corner of the corresponding octant shell member. When four of the pieces 80 are all aligned together at a conjunction, the four pieces may be rotated about their common point of contact relative to the rest of the puzzle. Additionally, the hemispheres defined by the great circles 30, 31 and 32 may be rotated relative to each other to produce a scrambled position of the puzzle as shown in FIG. 10. The puzzle can be solved by employing steps of rotating hemispheres and rotating circle corner pieces at conjunctions in order to bring about reorientation of the corner pieces and the octant members to their starting position of FIG. 9.

Figure 13:
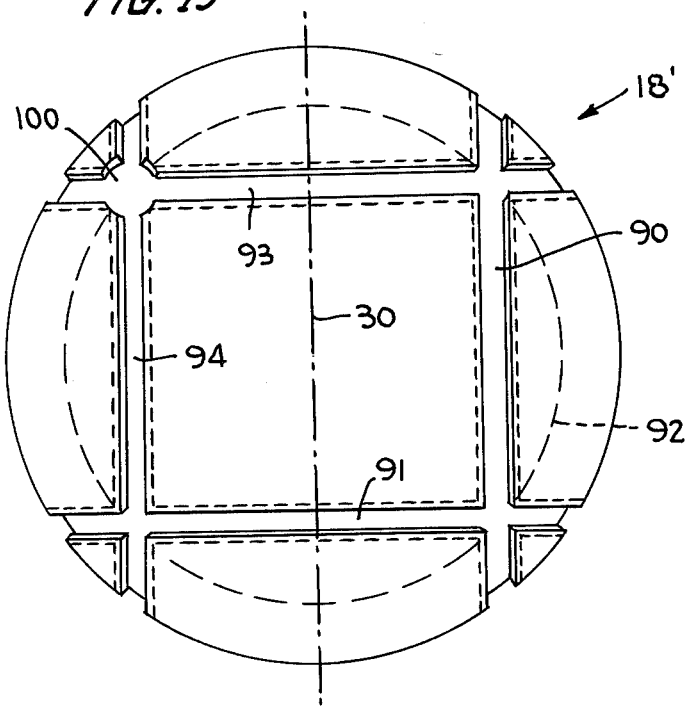
FIG. 13 is a perspective view of a modified support in a another modified puzzle.
Figure 14:
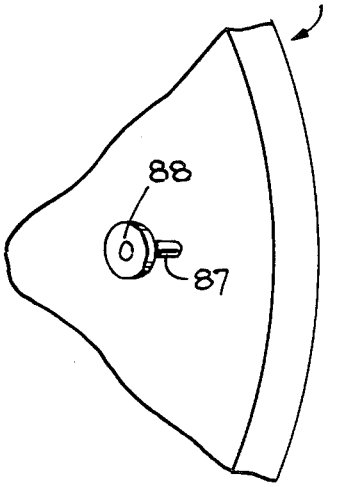
FIG. 14 is a perspective view of a sliding element for engaging and sliding on the center support of FIG. 13.

In a further variation, illustrated by a modified core 18' in FIG. 13 and a modified octant member 21'' in FIG. 14, each of the octant members 21'' have only one leg 87 on which is mounted a round foot 88 centered relative to the leg 87. The support 18' includes tracks 90, 91, 92 (on the rear of the support as indicated by the dashed lines) 93 and 94. An additional track could be located on the front of the support to follow the position of the dashed line 92. The center line of each track is positioned at a latitude of 35.2644° from its corresponding equator. For example, the center of the track 90 is 35.2644° from the great circle shown by the long and short dashed line 30. The tracks 90, 91, 92, 93 and 94, similar in cross-section to the tracks of the embodiment of FIGS. 6 and 7, are adapted to receive the legs 87 and feet 88 such that each of the feet 88 engage both lips of the corresponding track to retain the outer member on the support. Preferably the legs 87 have a length designed to slidably engage the interior surface of each of the octant members or outer shell members against the surface of the spherical support 18' to prevent wobbling of the member. Only three of the tracks 90, 91 and 92 are necessary; the tracks 93 and 94 being provided to enable assembly of the parts on the support prior to securing an octant member over the front intersection of the tracks 93 and 94. Conveniently, the lips are cut away at the front intersection of the tracks 93 and 94 to provide an enlarged opening 100 into which the feet 88 may be inserted to assemble the octant members on the spherical support 18'. After assembly of the seven slding octant members, the member being permanently fixed to the sphere can be assembled over the opening 100 and fixed to the sphere to complete the assembly. The tracks 93 and 94 are then not to be used in the puzzle.

The modified puzzle of FIGS. 13 and 14 has the advantage of having only one leg for each of the sliding octant members. The feet 88 are held under two track lips and thus are more reliably held to the tracks, particularly at the intersections. The circular shape of the feet 88 insure even engagement of the feet with the lips irrespective of the position of the octant member on the puzzle. Also with only one foot on each octant member, there is no possibility of two feet becoming entangled with each other.

The great circles 30, 31 and 32 of the preceding embodiments can be imagined as projections of the edges of an octahedron from its center onto a concentric spherical shell. Thus the edges of the octahedron define three equatorial planes. The octahedron is the only one of the five classical regular solids whose edges define equatorial planes.

Figure 16:
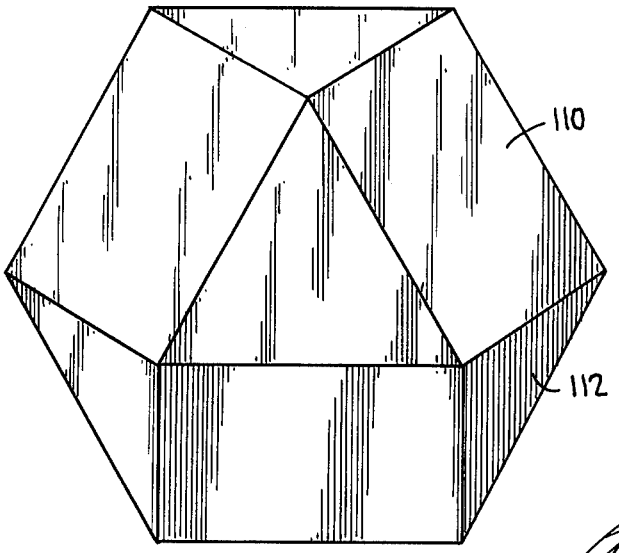
FIG. 16 is a perspective view of still another variation of the puzzle in accordance with the invention.
Figure 18:
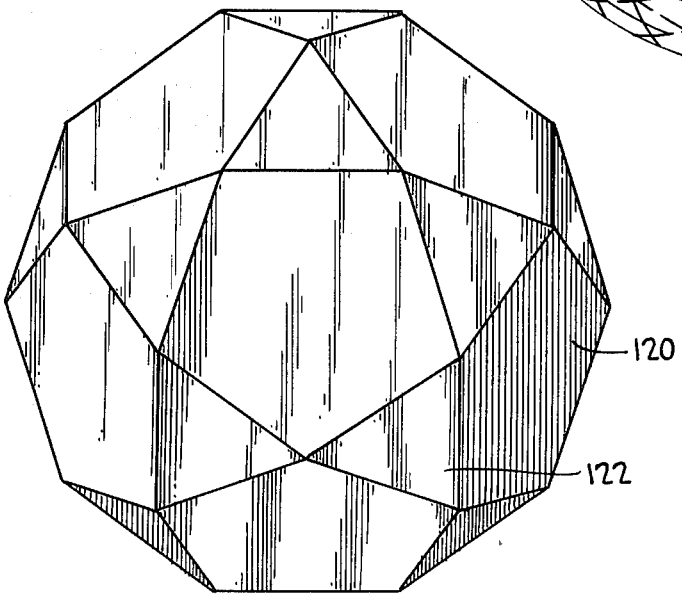
FIG. 18 is a perspective view of a still further variation of the puzzle in accordance with the invention.

The puzzle can be made in other spherical polyhedral configurations wherein the equatorial planes are defined by the edges, projected from the center, of semi-regular polyhedra. Examples of such semi-regular polyhedra are the cuboctahedron shown in FIG. 16 with six square faces 110 and eight equilateral triangular faces 112, and the icosidodecahedron shown in FIG. 18 with twelve pentagonal faces 120 and twenty equilateral triangular faces 122. The cuboctahedron defines four equators or great circles about which hemispheres can be relatively rotated while the icosidodecahedron defines six such equators.

In a spherical shell, wherein the outer spherical shell members are formed in accordance with a cuboctahedron or an icosidodecahedron, the sliding outer shell members are preferably held in tracks by center legs and feet. Alternatively, corner legs and feet could be employed; however, this involves a much greater number of legs, feet and tracks.

Figure 15:
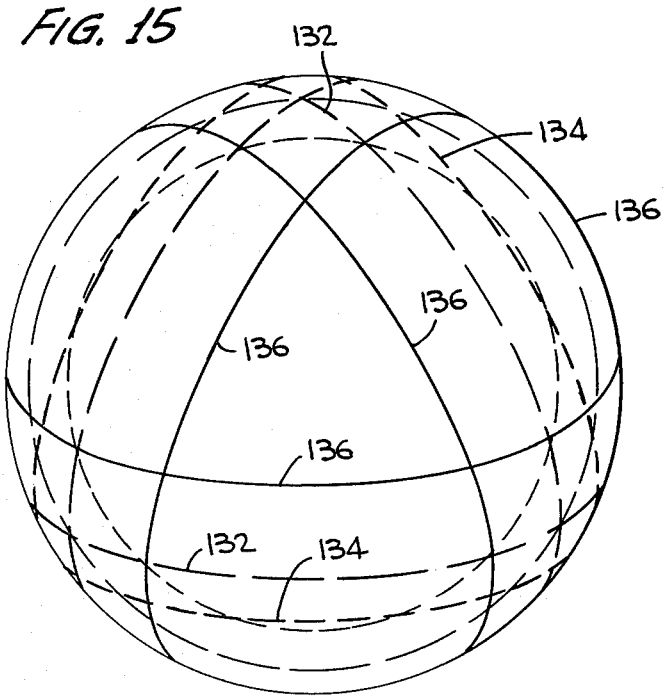
FIG. 15 is a diagrammatical sketch of another variation of the puzzle in accordance with the invention.

With a single central leg and foot for each of the outer triangular members or square members of a cuboctahedron, two tracks are required for each hemisphere of rotation for a total of eight required tracks. The tracks for the triangular members 112 are illustrated by the long dashed lines 132 in FIG. 15 and the tracks for the square members 110 are illustrated by the short dashed lines 134 while the solid lines 136 indicate the equators. The equators 136 intersect at an angle of 70.53°. Each track 132 is 19.47° from its equator 136 while each track 134 is 35.26° from its equator 136. Either a triangular member or a square member of the outer shell must be fixed to the center support. In FIG. 15 a triangular member would be so fixed.

Figure 17:
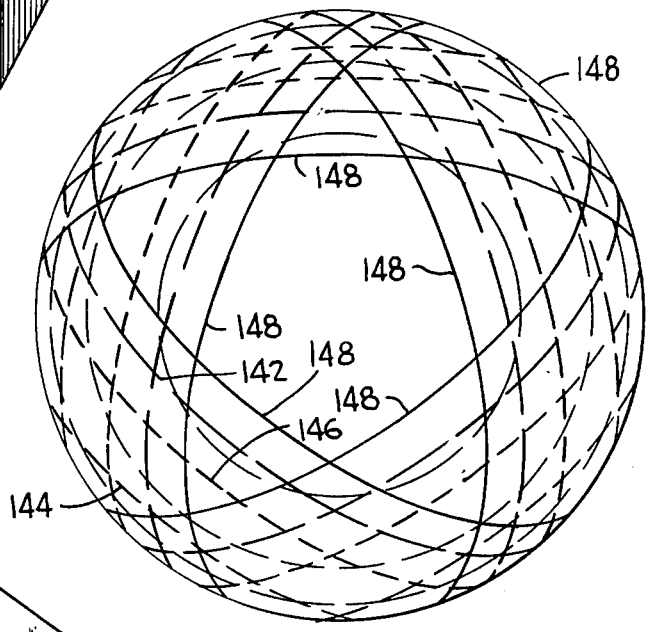
FIG. 17 is a perspective view of a further variation of the puzzle in accordance with the invention.

In the icosidodecahedron, three tracks are required for each rotating hemisphere producing eighteen tracks for the sphere wherein one of the pentagonal or triangular members is fixed on the center support. Long dashed lines 142 and 144 in FIG. 17 represent tracks for different groups of the triangular members 122 while short dashed lines 146 illustrate the position of tracks for the pentagonal members 120, and the solid lines 148 illustrate the equators. FIG. 17 is drawn so that a pentagonal member of the outer shell must be fixed to the center support. The equators 148 intersect at an angle of 63.43°. Each track 142 is 10.81° from its equator 148, each track 144 is 52.62° from its equator 148, and each track 146 is 26.57° from its equator 148.

Coding of starting positions for the spherical polyhedrons having greater than eight outer members can be the same as for the eight outer member spherical polyhedron of FIG. 1. However, for the icosidodecahedron there will be thirty junctions at which four corners meet requiring thirty different codings; thus it may be preferable to code by using a combination of solid colors, stripes and/or to use numbers, letters, or other indications. For purposes of assembling the outer sliding members, an additional track or tracks (not shown but similar to the tracks 93 and 94 of FIG. 13) can be included.

A more complex version can be made by providing corner pieces in the cuboctrahedron or icosidodecahedron similar to the corner pieces of the embodiment of FIG. 9.

Since many modifications, variations, and changes in detail may be made to the above described embodiments, it is intended that all matter in the foregoing description and shown in the accompanying drawings be interpreted as illustrative and not in a limiting sense.

What is claimed is:

1. A three-dimensional sliding element puzzle comprising a spherical center support including means forming at least three crossing tracks wherein each track forms a complete circle in the support and includes a pair of outer lips extending toward each other to define a narrow outer slot and inner enlarged sliding path, said narrow outer slots having a width less than one-sixteenth of the circumference of the support, a plurality of at least fourteen outer members wherein one of the outer members is fixed on the support and the other outer members are slidable on the support, legs mounted on the slidable outer members and extending through the narrow slot of the corresponding tracks, disk-like feet which are substantially round in circumference being mounted on inner ends of the respective legs for sliding in the inner sliding paths and for being engaged by inner surfaces of the lips to slidingly retain the slidable members on the support, said outer members forming a shell completely enclosing the spherical support with edges of each outer members, said outer members when in one relative position defining at least three pairs of hemispherical shells wherein one hemispherical shell of each pair of the pairs of hemispherical shells is rotatable relative to the corresponding other hemispherical shells of each pair of hemispherical edges of the hemispherical shells of each pair of hemispherical shells sliding relative to each other, and wherein the fourteen outer members are in a cuboctahedron arrangement, six of the outer members defining six generally square faces, and the other outer members defining generally equilateral triangular faces.

2. A three-dimensional sliding element puzzle comprising a spherical center support including means forming at least eight crossing tracks wherein each track forms a complete circle in the support and includes a pair of outer lips extending toward each other to define a narrow outer slot and an inner enlarged sliding path, a plurality of at least fourteen outer members in a cuboctahedron arrangement wherein six of the outer members have faces which are square-like and the other eight outer members have faces which are equilateral-triangle-like, one of the outer members being fixed on the support and the other outer members being slidable on the support, legs mounted on the slidable outer members and extending through the narrow slot of the corresponding tracks, disk-like feet mounted on inner ends of the respective legs for sliding in the inner sliding paths and for being engaged by inner surfaces of the lips to slidingly retain the slidable members on the support, said outer members forming a shell completely enclosing the spherical support, and said outer members when in one relative position defining at least four pairs of hemispherical shells wherein one hemispherical shell of each pair of the pairs of hemispherical shells is rotatable relative to the corresponding other hemispherical shell.

* * * * *

UNITED STATES PATENT AND TRADEMARK OFFICE

CERTIFICATE OF CORRECTION

PATENT NO. : 4,478,418

DATED : October 23, 1984

INVENTOR(S) : Benjamin F. Sherman, Jr. and Samuel Francis

It is certified that error appears in the above–identified patent and that said Letters Patent are hereby corrected as shown below:

On the title page, the inventors' line should read:

[76] INVENTORS: Benjamin F. Sherman, Jr., 6329 Mori Street, Samuel Francis, 1202 Perry William Drive, both of McLean, VA 22101

Signed and Sealed this

*Eighteenth* Day of *June 1985*

[SEAL]

*Attest:*

DONALD J. QUIGG

*Attesting Officer* *Acting Commissioner of Patents and Trademarks*